US007578110B2

(12) United States Patent
Jenkins

(10) Patent No.: US 7,578,110 B2
(45) Date of Patent: Aug. 25, 2009

(54) MODULAR FRAME CONNECTOR SYSTEM

(76) Inventor: Joseph W. Jenkins, 134 Main St., N. Kingstown, RI (US) 02852

( * ) Notice: Subject to any disclaimer, the term of this patent is extended or adjusted under 35 U.S.C. 154(b) by 655 days.

(21) Appl. No.: 10/861,374

(22) Filed: Jun. 7, 2004

(65) Prior Publication Data

US 2005/0284038 A1 Dec. 29, 2005

(51) Int. Cl.
*E04H 12/00* (2006.01)
*E04B 1/61* (2006.01)
*E04C 3/00* (2006.01)

(52) U.S. Cl. ..... 52/655.1; 52/481.2; 52/656.9; 52/653.2; 52/848; 52/844; 52/766; 52/767

(58) Field of Classification Search ..... 52/655.1, 52/481.2, 656.9, 653.2, 775, 848, 844, 766, 52/767; 403/297, 231, 257, 409.1, 256, 263, 403/264, 322, 252, 255
See application file for complete search history.

(56) References Cited

U.S. PATENT DOCUMENTS 3,574,367 A 4/1971 Jankowski
3,669,479 A 6/1972 Payne
3,901,609 A 8/1975 Gostling
3,966,342 A * 6/1976 Moriya ..... 403/256
4,168,922 A 9/1979 Worrallo
4,207,014 A * 6/1980 Worrallo ..... 403/187
4,345,849 A * 8/1982 Stenemann ..... 403/252
4,485,597 A * 12/1984 Worrallo ..... 52/479
4,549,832 A * 10/1985 Sterl ..... 403/264
4,556,337 A * 12/1985 Marshall ..... 403/255
4,572,694 A 2/1986 Hoeksema
4,907,388 A * 3/1990 Siahatgar ..... 52/481.2
5,015,117 A 5/1991 Pawlicki
5,048,995 A 9/1991 Beaulieu
5,184,920 A * 2/1993 Strassle ..... 403/171
5,269,619 A 12/1993 Warkus
5,315,805 A * 5/1994 Harsch ..... 52/775
5,464,298 A * 11/1995 Schomakers ..... 403/252
5,605,410 A * 2/1997 Pantev ..... 403/297
5,647,682 A 7/1997 Riehm (Continued)

*Primary Examiner*—Richard E Chilcot, Jr.
*Assistant Examiner*—Mark R Wendell
(74) *Attorney, Agent, or Firm*—Rothwell, Figg, Ernst & Manbeck, P.C.

(57) ABSTRACT

A modular frame connection is formed by abutting a front camming surface of a front camming end of a front fastening plate against a rear camming surface of a rear camming end of a rear fastening plate while a front pierced end of the front fastening plate and rear pierced end of the rear fastening plate are separated, inserting the front and rear camming ends between a front and rear flanges of a post or beam, rotating the front pierced end toward the rear pierced end until a front finger surface of the front camming end is disposed insertably between a front lip of the front flange and a web of the post or beam and abutably to the front flange and a front abutment surface substantially orthogonal to the front fastening plate is disposed abutably to the web, rotating the rear pierced end toward the front pierced end until a rear finger surface of the rear camming end is disposed insertably between a rear lip of the rear flange and the web of the post or beam and abutably to the rear flange and a rear abutment surface substantially orthogonal to the rear fastening plate is disposed abutably to the web.

16 Claims, 12 Drawing Sheets

U.S. PATENT DOCUMENTS 5,657,604 A * 8/1997 Malott ..... 52/655.1
5,673,531 A * 10/1997 Carcedo et al. ..... 52/656.9
6,397,551 B1 * 6/2002 Lewcock et al. ..... 52/655.1
6,505,453 B1 * 1/2003 Rixen et al. ..... 52/655.1
6,712,540 B2 * 3/2004 Schmalzhofer et al. ..... 403/248
6,969,211 B2 * 11/2005 Altman ..... 403/374.4

* cited by examiner

MODULAR FRAME CONNECTOR SYSTEM

BACKGROUND OF THE INVENTION

1. Field of the Invention

The invention relates to modular frame connectors, such as those that might be used for connecting structural framing, and framing structures utilizing the modular frame connectors.

2. Description of the Related Art

Structures such as houses have been built traditionally with roofs and walls supported by frames made of lumber. The frames are often secured by nails or bolts. Nailing or bolting a structural frame together requires considerable skill. Frames that are nailed or bolted may not be adjusted easily after assembly to accommodate shifting foundations or misalignments. It would be desirable if a frame connection were quickly and easily made. It would be desirable if a location of a frame connection were adjustable after connection. It would be desirable for future additions to the structure to be easily attached. It would be desirable for all elements of the structure to be easily de-mountable so that they may be replaced or re-used.

Modular construction was developed to reduce the costs associated with building custom structures. Modular construction utilizes standardized parts, many of which can be fabricated at a factory, that are delivered to a building site and assembled. Several modular buildings can be assembled at once, in the manner of an assembly line. Such modular buildings may be used to make affordable low-income housing more widely available.

Modular construction, however, presents special problems. Modular structures are built ideally in assembly line fashion from relatively standardized components. Components made from lumber may be difficult to standardize. Since lumber takes years to produce, it may fluctuate in price. It would be desirable if a frame and its connectors could be fabricated from a metal or a polymer, or a combination thereof. It would further be desirable if structural connection could be made quickly and easily. Finally, it would be desirable if connectors could be adapted to structural elements with relatively well-known strength properties, such as wide-flange beams.

SUMMARY OF THE INVENTION

A primary object of the invention is to overcome the deficiencies of the related art described above by providing a novel modular frame connector. The present invention achieves these objects and others by providing a modular frame connector system.

In particular, in a first aspect of the invention, a modular frame connector system includes a beam or post having a web and front and rear flanges disposed fixedly on the web, a front lip disposed fixedly on a lower surface of the front flange distal from the web, a front fastening plate having a front camming end disposed insertably between the front and rear flanges and a front pierced end, the front camming end comprising further, a front abutment surface substantially orthogonal to the front fastening plate and disposed abutably to the web, a front finger surface disposed insertably between the front lip and the web and abutably to the front flange, a front complementary surface disposed substantially parallel to the front fastening plate, and a front camming surface disposed at a first predetermined angle to the front abutment surface and the front complementary surface, a rear lip disposed fixedly on an upper surface of the rear flange substantially opposite the front lip and distal from the web, a rear fastening plate having a rear camming end disposed insertably between the front complementary surface and the rear flange and a rear pierced end, the rear camming end comprising further, a rear abutment surface substantially orthogonal to the rear fastening plate and disposed abutably to the web, a rear finger surface disposed insertably between the rear lip and the web and abutably to the rear flange, a rear complementary surface disposed substantially parallel to the rear fastening plate and abutably to the front complementary surface, and a rear camming surface disposed at a second predetermined angle to the rear abutment surface and the rear complementary surface, wherein the front camming surface is disposed abutably against the rear camming surface while the front and rear pierced ends are separated to insert the front and rear camming end between the front and rear flanges.

In a second aspect of the invention, a modular frame connector system includes a beam or post having a web and front and rear flanges disposed fixedly on the web, a front lip disposed fixedly on a lower surface of the front flange distal from the web, a front fastening plate having a front camming end disposed insertably between the front and rear flanges and a front pierced end, the front camming end comprising further, a front abutment surface substantially orthogonal to the front fastening plate and disposed abutably to the web, a front finger surface disposed insertably between the front lip, and the web and abutably to the front flange, a front complementary surface disposed substantially parallel to the front fastening plate, and a front camming surface disposed at a first predetermined angle to the front abutment surface and the front complementary surface, wherein the front camming surface is disposed abutably against the rear flange while the front pierced end is raised to insert the front camming end between the front and rear flanges.

In a third aspect of the invention, a method of modular frame connection includes abutting a front camming surface of a front camming end of a front fastening plate against a rear camming surface of a rear camming end of a rear fastening plate while a front pierced end of the front fastening plate and rear pierced end of the rear fastening plate are separated, inserting the front and rear camming ends between a front and rear flanges of a beam or post, rotating the front pierced end toward the rear pierced end until a front finger surface of the front camming end is disposed insertably between a front lip of the front flange and a web of the post and abutably to the front flange and a front abutment surface substantially orthogonal to the front fastening plate is disposed abutably to the web, rotating the rear pierced end toward the front pierced end until a rear finger surface of the rear camming end is disposed insertably between a rear lip of the rear flange and the web of the post and abutably to the rear flange and a rear abutment surface substantially orthogonal to the rear fastening plate is disposed abutably to the web.

The above and other features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
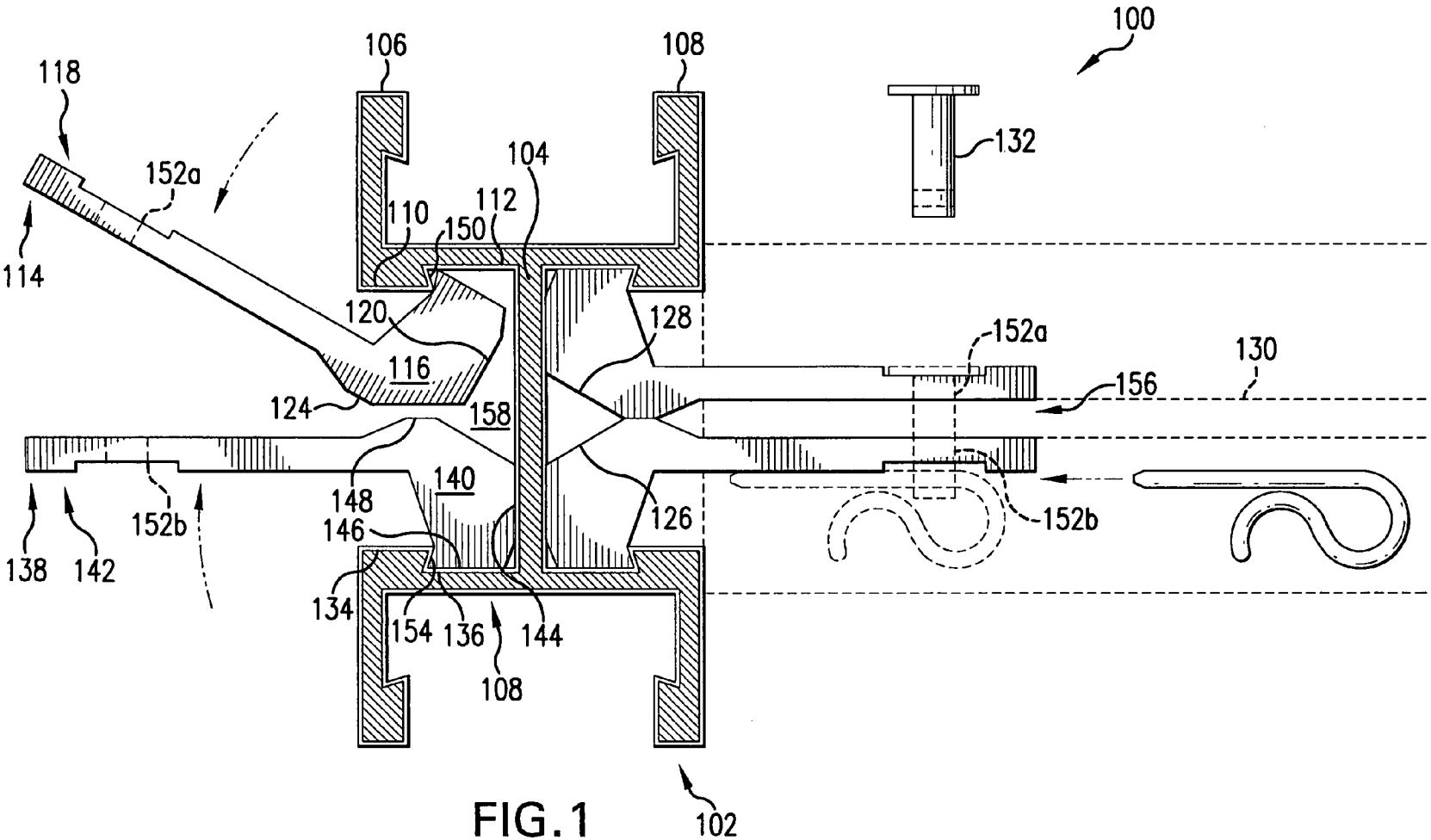
FIG. 1 is a plan view of a modular frame connector system according to a first embodiment of the present invention.
Figure 5B:
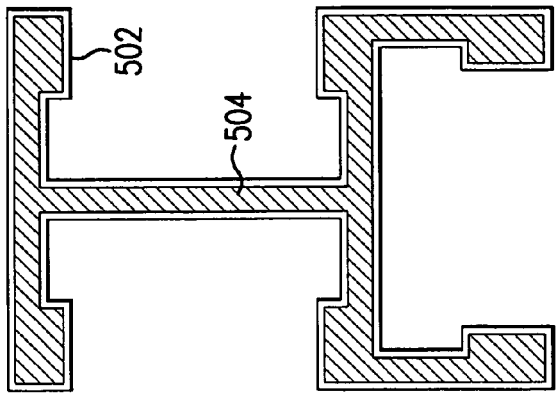
FIGS. 5A through 5F are post/beam sections for use with an embodiment of the present invention.
Figure 5A:
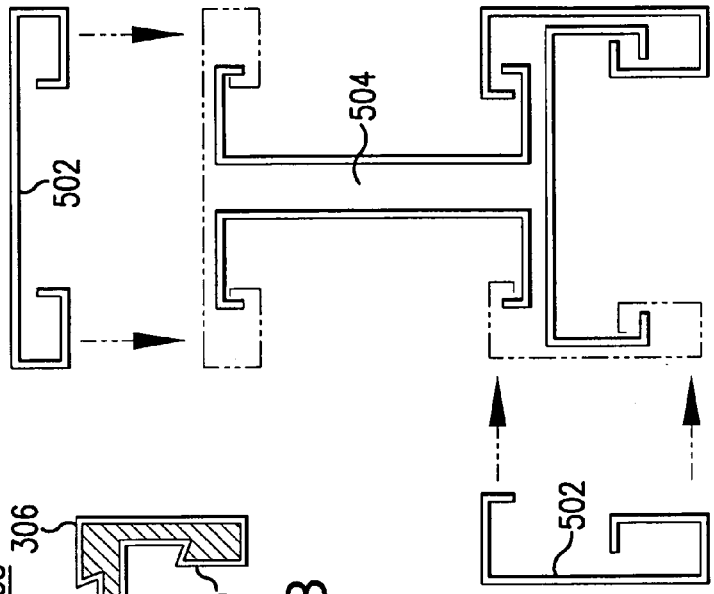

In FIG. 1 is shown a modular frame connector system 100 according to a first embodiment of the present invention. Modular frame connector system 100 may include a beam, stanchion, column, pillar, or post 102 having a web 104 and a front and rear flanges 106 and 108 which are disposed fixedly on web 104. The designations "front" and "rear" as used herein are merely convenient labels for various elements and are not intended to imply any particular physical orientation or order of installation.

In several embodiments, post 102 may be similar to an I-beam or a W-beam, such as a modified wide flange beam as shown in FIG. 1. This profile and others shown in FIGS. 2-4, 5D and 5F may be used as a post, beam or rafter. In several embodiments, post 102 may have a skin made of a brake-formed or extruded metal substantially resistant to oxidation, such as aluminum. The skin may also be made of a coated cold- or hot-rolled steel, such as galvanized steel. Post 102 may have either no core at all, as shown in FIG. 5F, or a core made of a polymer such as high density polyethylene (HDPE), polyethylene terephthalate (PET), a recycled automotive polymer product, an aluminum-polymer matrix, or any filler material suitable for providing some resistance to deformation, as shown in FIGS. 5C and 5D. In alternative embodiments, the skin of post 102 itself may be extruded, hydro-formed, cast, forged, or drawn.

A front lip 110 is disposed fixedly on a lower surface 112 of front flange 106 distal from web 104. In one embodiment, front lip 110 may have a front inner surface 150 substantially parallel to web 104. In another embodiment, front inner surface 150 is inclined relative to web 104.

A front fastening plate 114 may have a front camming end 116 disposed insertably between front and rear flanges 106 and 108 as shown in FIG. 1. Front fastening plate 114 may also have a front pierced end 118 distal from front camming end 116. Front pierced end 118 may have an aperture 152*a* suitable for insertion of a fastener 132. Front camming end 116 may also have a front abutment surface 120 substantially orthogonal to a front complimentary surface 124 of front fastening plate 114.

Front abutment surface 120 is disposed so as to abut web 104 when front camming end 116 is inserted between front and rear flanges 106 and 108. A front finger surface 122 of front camming end 116 is disposed insertably between front lip 110 and web 104 and abutably to front flange 106. Front complimentary surface 124 is disposed substantially parallel to front fastening plate 114, and a front camming surface 128 is disposed at a predetermined angle to front abutment surface 120 and front complimentary surface 124.

A rear lip 134 may be disposed fixedly on an upper surface 136 of rear flange 108 substantially opposite front lip 110 and distal from web 104 as shown in FIG. 1. In one embodiment, rear lip 134 may have a rear inner surface 154 substantially parallel to web 104. In another embodiment, rear inner surface 154 may be inclined relative to web 104. A rear fastening plate 138, also shown in FIG. 12, having a rear camming end 140 is disposed insertably between front complimentary surface 124 and rear flange 108, as shown in FIG. 1.

A rear lip 134 may be disposed fixedly on an upper surface 136 of rear flange 108 substantially opposite front lip 110 and distal from web 104 as shown in FIG. 1. In one embodiment, rear lip 134 may have an rear inner surface 154 substantially parallel to web 104. In another embodiment, rear inner surface 154 may be inclined relative to web 104. A rear fastening plate 138, shown in FIG. 12, having a rear camming end 140 is disposed insertably between front complimentary surface 124 and rear flange 108, as shown in FIG. 1.

Figure 12:
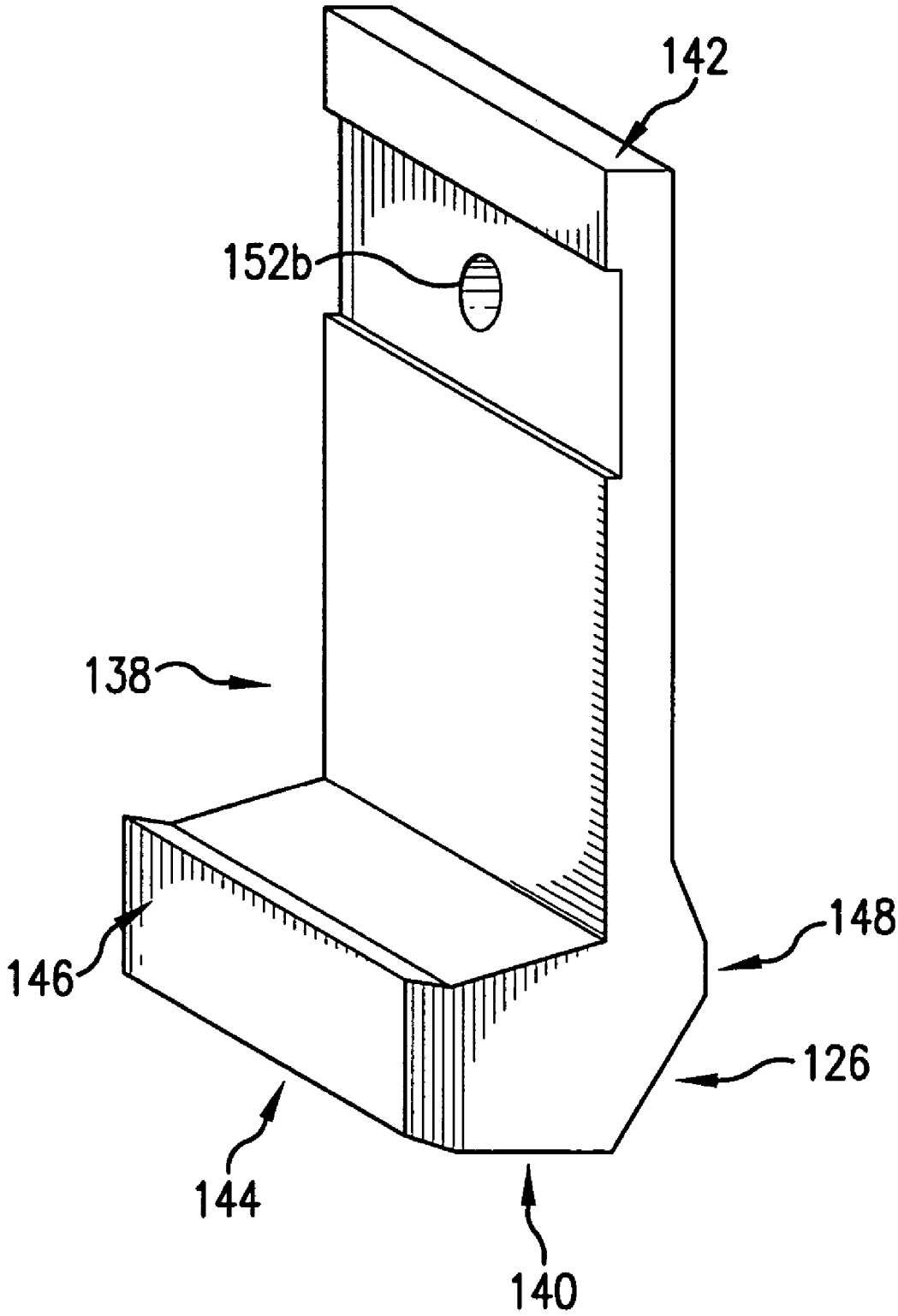
FIG. 12 is a fastening plate for use with an embodiment of the present invention.

Rear fastening plate 138 may also have a rear pierced end 142 distal from rear camming end 140, as shown in FIG. 12. Rear pierced end 138 may have an aperture 152*b* suitable for insertion of fastener 132. Rear camming end 140 may have a rear abutment surface 144 substantially orthogonal to rear fastening plate 138 and disposed abutably to web 104.

A rear finger surface 146 is disposed insertably between rear lip 134 and web 104 and abutably to rear flange 108. A rear complementary surface 148 is disposed substantially parallel to rear fastening plate 138 and abutably to front complimentary surface 124. A rear camming surface 126 is disposed at a predetermined angle to rear abutment surface 144 and rear complementary surface 148.

In one embodiment, web 104 and front and rear flanges 106 and 108 form a channel 158 as shown in FIG. 1. Channel 158 may receive front and rear fastening plates 114 and 138. If both front and rear fastening plates 114 and 138 are used they may be referred to collectively as a type "A" fastener. In one embodiment, front and rear fastening plates 114 and 138 are inserted "back to back" in channel 158. In other embodiments, front and rear fastening plates 114 and 138 are inserted into channel 158 simultaneously or separately.

In one embodiment, front and rear pierced ends 118 and 142 are separated to insert front and rear camming ends 116 and 140 between front and rear flanges 106 and 108. In this embodiment, front camming surface 128 is disposed abutably against rear camming surface 126 so front and rear camming ends 116 and 140 clear front and rear lips 110 and 134. In one embodiment, front and rear camming ends 116 and 140 are inserted until front and rear abutment surfaces 120 and 144 bottom out against web 104. In this embodiment, front and rear pierced ends 118 and 142 are rotated together after front and rear abutment surfaces 120 and 144 bottom out against web 104.

A structural member 130 may be grasped between front and rear fastening plates 114 and 138 and fastener 132 inserted through apertures 152*a* and 152*b* and structural member 130 to secure front and rear fastening plates 114 and 138 to structural member 130.

In one embodiment, structural member 130 is disposed insertably between front and rear pierced ends 118 and 142 while they are separated. In another embodiment, a space 156 is formed between front and rear pierced ends 118 and 142 into which structural member 130 is inserted after front and rear pierced ends 118 and 142 have been rotated together. In other embodiments, structural member 130 may be a second post, a beam, a joist, a stud, a panel, or a fastener.

In one embodiment, a fastener 132 is disposed pierceably through front and rear pierced ends 118 and 142 and structural member 130. In some embodiments, fastener 132 is any suitable fastening device such as, for example, a pin, a bolt, a rivet, or a spike. A width of channel 158 and a length 164 of post 102 may be set to accommodate common light gauge metal framing elements such as, for example, panels, corrugated sheeting, or light gauge metal joists and studs. In one illustrative embodiment, the width of channel 158 and the length 164 of post 102 may be set to accommodate common light gauge metal framing elements such as, for example, 4×8 foot panels, ½ inch corrugated sheeting, or 3 inch light gauge metal joists and studs. Inner or outer walls, barriers, ceilings, and roofs could be formed from elements such as these.

Figure 7B:
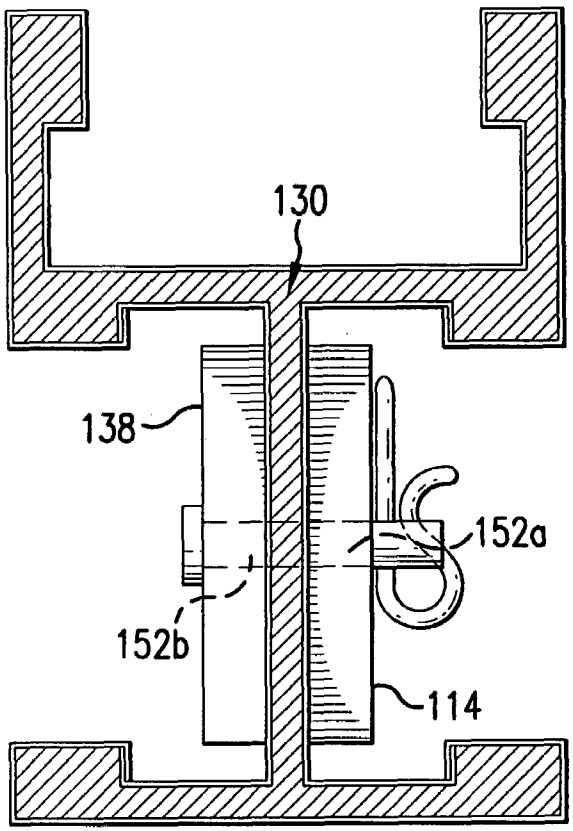
FIGS. 7A and 7B are alternate views of the embodiment shown in FIG. 1.
Figure 7A:
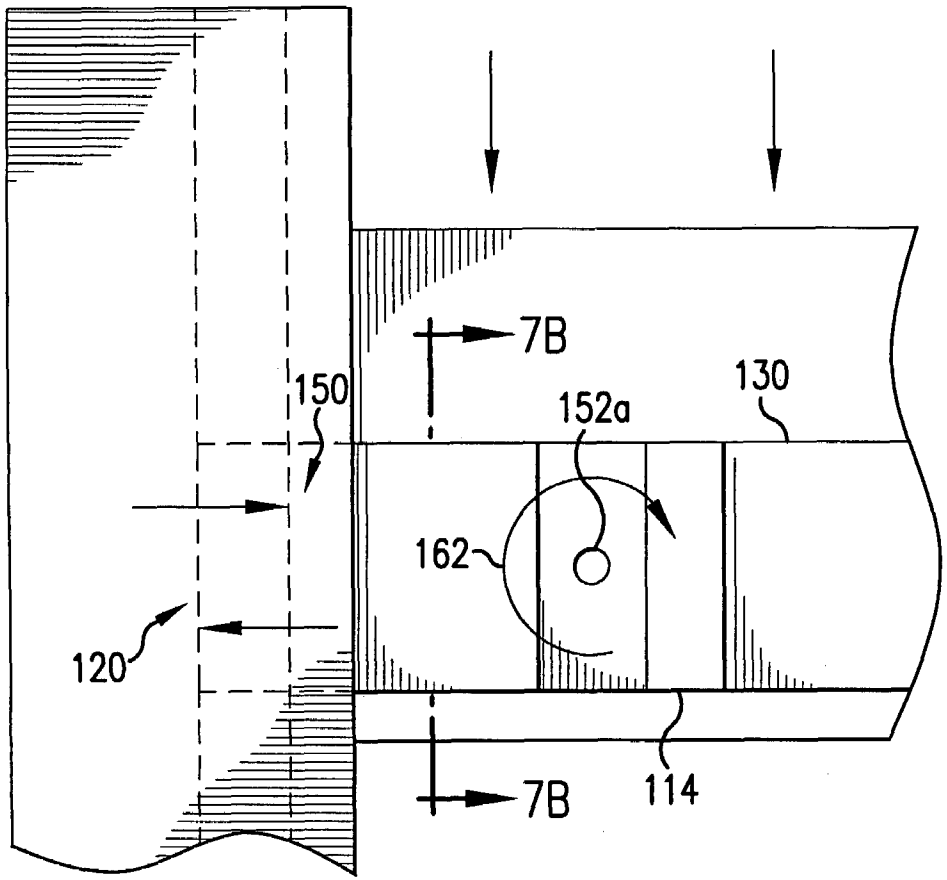

Front and rear fastening plates 114 and 138 may connect post 102 to structural member 130 by the insertion of front and rear fastening plates 114 and 138 into channel 158 and by grasping structural member 130 between front and rear pierced ends 118 and 142 as shown in FIG. 1. Fastener 132 may be inserted through apertures 152*a* and 152*b* to secure front and rear fastening plates 114 and 138 to structural member 130 while allowing a loading due to a rotational moment 162 of structural member 130 about front and rear abutment surfaces 120 and 144 to be transferred to channel 158, as shown in FIG. 7A. As a result, shear forces may be focused at surfaces 120 and 144, web 104, and front and rear inner surfaces 150 and 154, thus jamming front and rear fastening plates 114 and 138 in channel 158.

In another embodiment, the loading is resolved into pressures at front and rear abutment surfaces 120 and 144, web 104, and front and rear inner surfaces 150 and 154 that produce shear forces along their surfaces. These forces jam front and rear fastening plates 114 and 138 in channel 158. A section through the structural member 130 surrounded by front and rear fastening plates 114 and 138 is shown in FIG. 7B.

In one embodiment, a single fastener 132 is used to secure front and rear pierced ends 118 and 142 and structural member 130. In this embodiment, front and rear fastening plates 114 and 138 may act as a moment arm when loaded. In this embodiment, a rotation of front and rear fastening plates 114 and 138 about front and rear abutment surfaces 120 and 144 may allow the plates to jam in channel 158, as shown in FIG. 7A. Jamming may arrest substantially a tendency for front and rear fastening plates 114 and 138 to travel along channel 158.

In another embodiment, a load on structural member 130 may cause front and rear fastening plates 114 and 138 to rotate about fastener 132, jamming front and rear abutment surfaces 120 and 144 against web 104. This rotation may focus shear forces between front and rear abutment surfaces 120 and 144 and web 104, preventing structural member 130 from sliding in channel 158. In one embodiment, friction between front and rear abutment surfaces 120 and 144 and web 104 may prevent structural member 130 from moving in channel 158. The coefficient of friction (μ) at the interface of front and rear abutment surfaces 120 and 144 and web 104 may be enhanced by knurling or by coating front and rear abutment surfaces 120 and 144 or web 104 with a high-μ compound, such as a silica impregnated paint.

Figure 13:
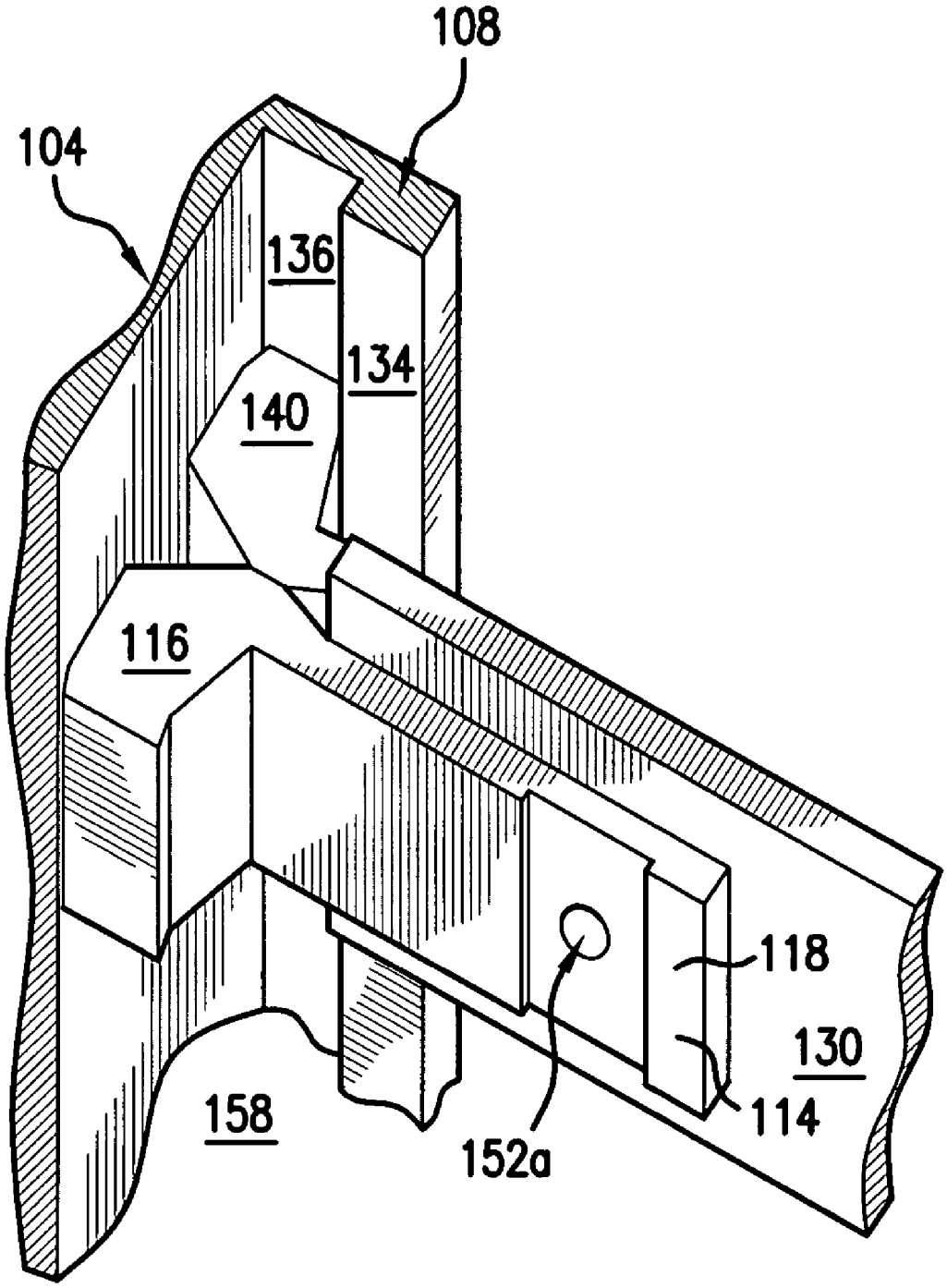
FIG. 13 is a three-quarter view, partially cut away, of the embodiment shown in FIG. 1.

In FIG. 13 is shown a partial cut-away view of the first embodiment. Rear lip 134 may be disposed fixedly on an upper surface 136 of rear flange 108 substantially distal from web 104. Front fastening plate 114 having front camming end 116 is disposed against web 104. Front fastening plate 114 may also have a front pierced end 118 distal from front camming end 116. Front pierced end 118 may have an aperture suitable for insertion of a fastener 132 through structural member 130.

Figure 3:
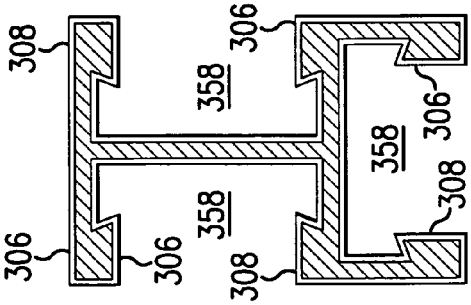
FIG. 3 is a post/beam section for use with an embodiment of the present invention.
Figure 2:
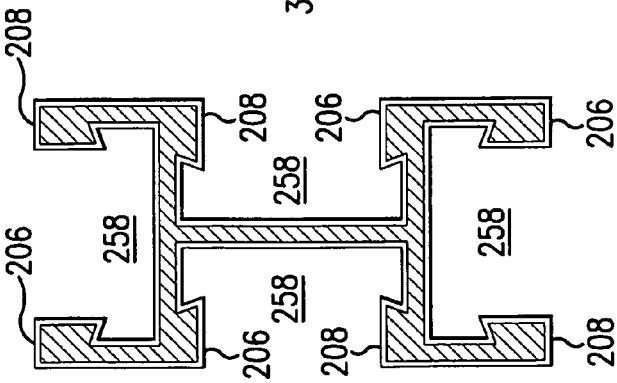
FIG. 2 is a post/beam section for use with an embodiment of the present invention.
Figure 4:
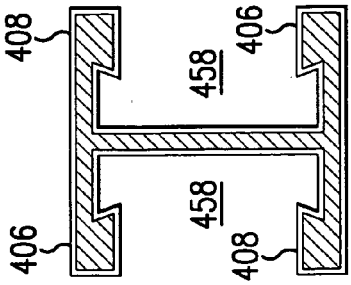
FIG. 4 is a post/beam section for use with an embodiment of the present invention.
Figure 5C:
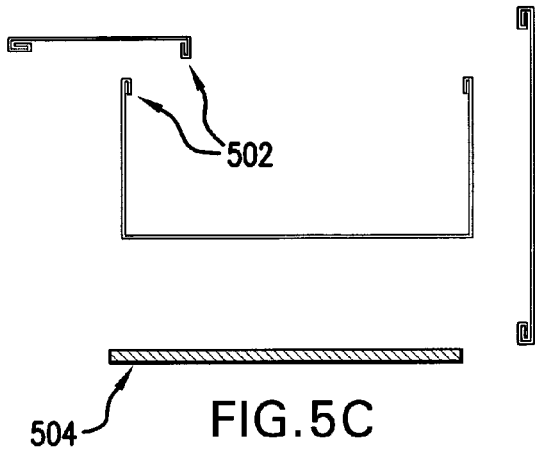
Figure 5D:
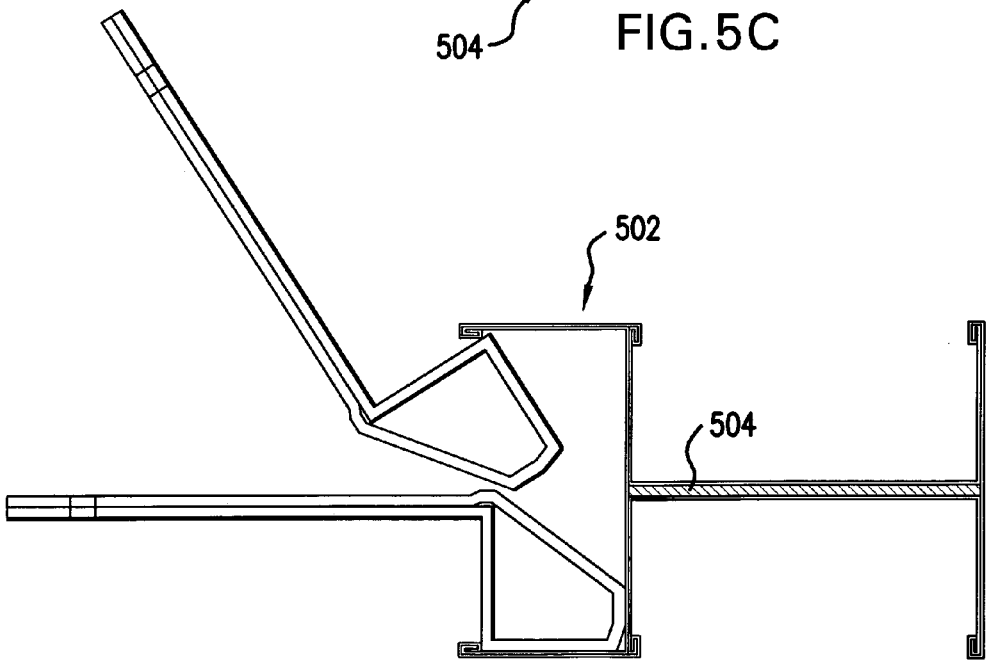

Several additional embodiments of posts 102, to be used as beams and rafters as well, are illustrated in FIGS. 2 through 4. In FIG. 2, for example, four sets of front and rear flanges 206 and 208 form four channels 258. Similarly, in FIG. 3, three sets of front and rear flanges 306 and 308 form three channels 358. Two sets of front and rear flanges 406 and 408 form three channels 458 in FIG. 4.

Figure 5E:
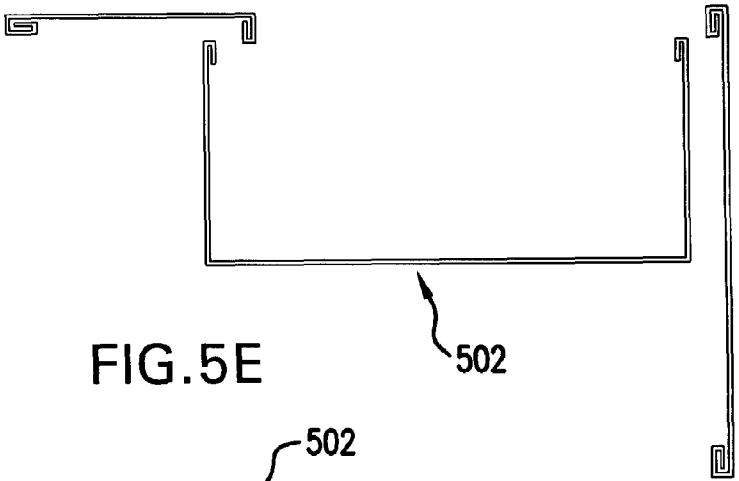
Figure 5F:
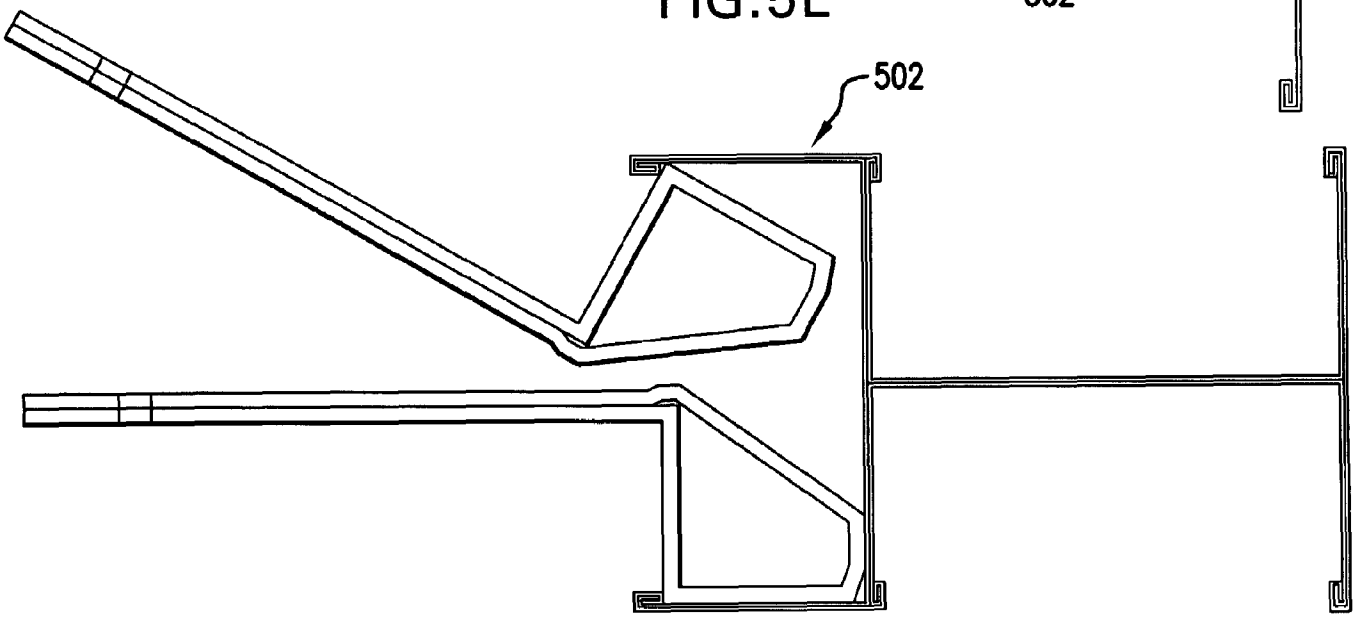

FIGS. 5A through 5D illustrate shells 502 being assembled over a core 504. In a preferred embodiment, shells 502 are made of a brake-formed aluminum. Also in a preferred embodiment, core 504 is made of a high density polyethylene (HDPE). FIGS. 5E and 5F illustrate shells 502 being assembled without a core.

Figure 6:
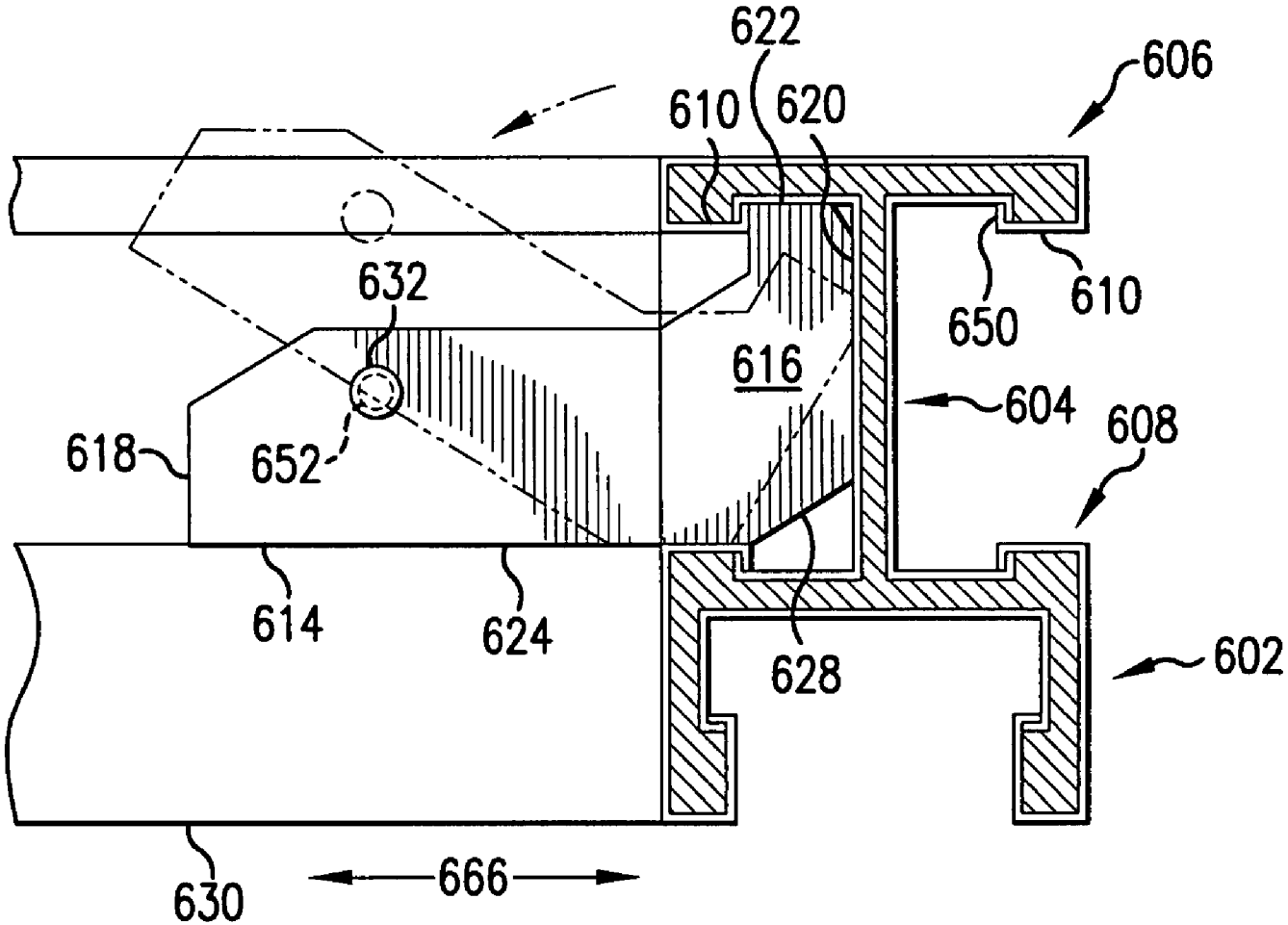
FIG. 6 is a modular frame connector system according to a second embodiment of the present invention.

In a second embodiment of the invention, illustrated in FIG. 6, one or more fastening plates 614 may be used. This embodiment may be referred to as a type "B" fastener. This embodiment may be used with a structural member 630 that has been rotated 90° with respect to a channel 658, as may be the case for joists, purlins or certain wall conditions such as ties. Aperture 652 in fastening plate 614 may flank structural member 630. Fastener 632 may be inserted through aperture 652 and structural member 630. More than one fastener 632 may be used.

In one embodiment, structural member 630 may be disposed proximate to a pierced end 618. In one embodiment, a fastener may be disposed pierceably through aperture 652 and structural member 630. In one embodiment, the fastener is any suitable fastening device such as, for example, a pin, a bolt, a rivet, or a spike. In several embodiments, structural member 630 is a second post, a beam, a joist, a stud, a panel, or a fastener.

In one embodiment, a post 602 has a web 604 and a front and rear flanges 606 and 608 disposed fixedly on web 604. A front lip 610 is disposed fixedly on a lower surface 612 of front flange 606 distal from web 604. In one embodiment, front lip 610 may have an inner surface 650 substantially parallel to web 604. In another embodiment, inner surface 650 is inclined relative to web 604.

Front fastening plate 614 may have a front camming end 616 disposed insertably between front and rear flanges 606 and 608 as shown in FIG. 6. Fastening plate 614 may also have a front pierced end 618 distal from front camming end 616. Front pierced end 618 may have an aperture 652*a* suitable for insertion of a fastener 632. Front camming end 616 may also have a front abutment surface 620 substantially orthogonal to a front complimentary surface 624 of fastening plate 614.

Front abutment surface 620 is disposed so as to abut web 604 when front camming end 616 is inserted between front and rear flanges 606 and 608. A front finger surface 622 of front camming end 616 is disposed insertably between front lip 610 and web 604 and abutably to front flange 606. Front complimentary surface 624 is disposed substantially parallel to fastening plate 614, and a front camming surface 628 is disposed at a predetermined angle to front abutment surface 620 and front complimentary surface 624.

Figure 8:
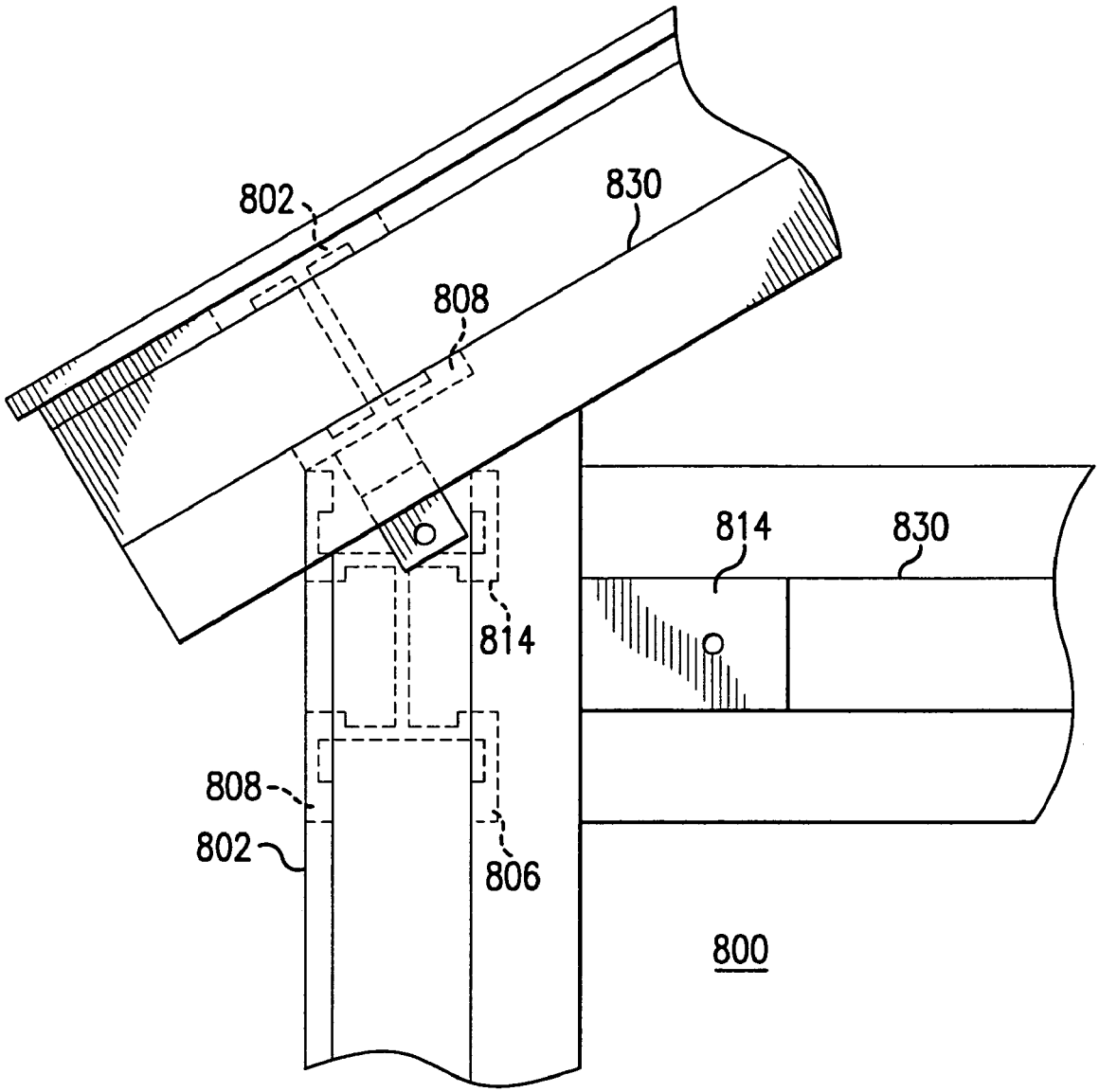
FIG. 8 is a rafter connection using the embodiment shown in FIG. 1.

FIG. 8 illustrates a type A fastener 800 used to support a rafter as structural member 830. Cross-sections of posts 802 reveal front fastener plate 814 within front and rear flanges 806 and 808. A size of fastener 800 may be made larger or smaller if necessary. A smaller version of a type A fastener 800 may be known as a type Aa fastener. Of course, the fasteners of the present invention are not limited to any particular size and can be made of any size suitable for a particular application.

Figure 9:
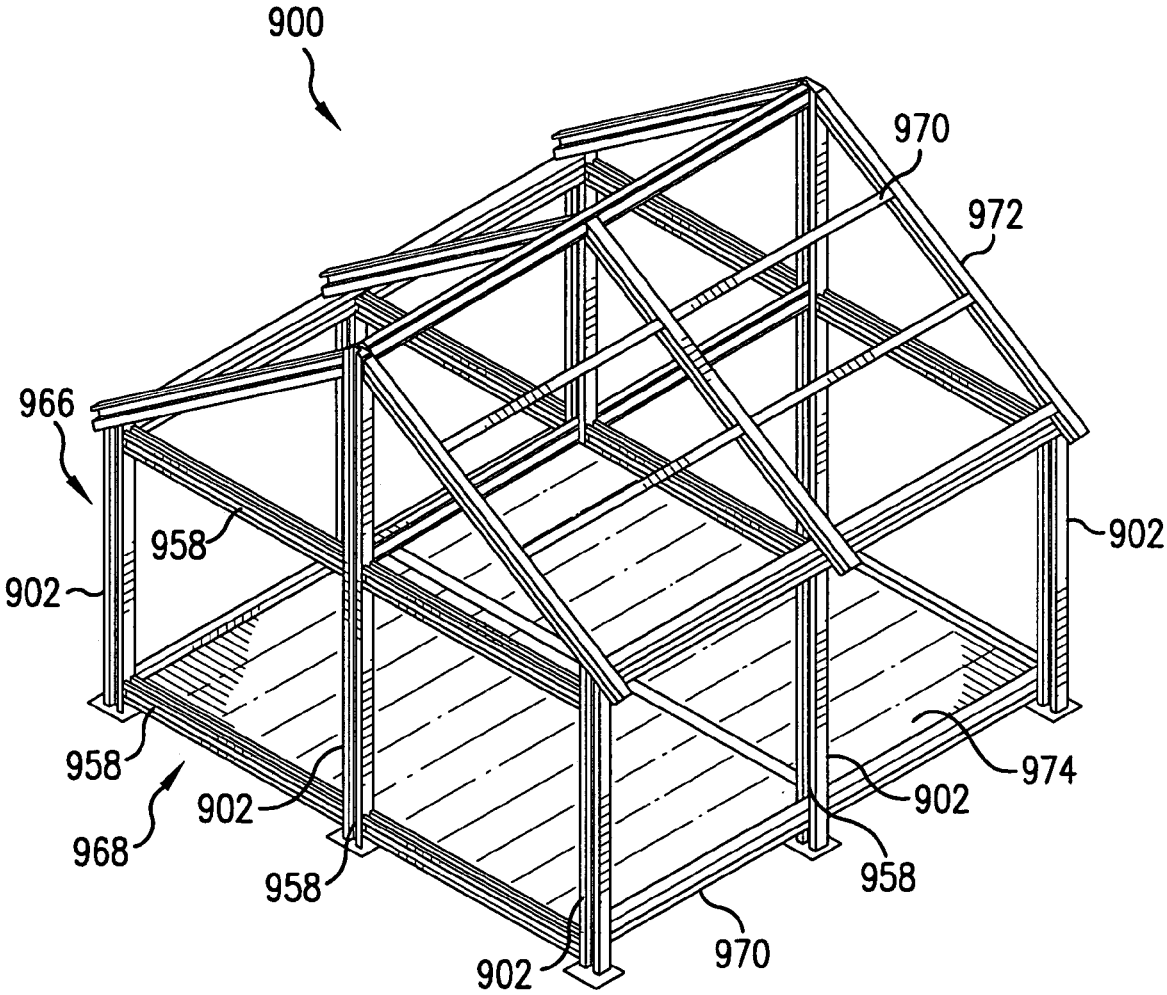
FIG. 9 is a framing structure for use with an embodiment of the present invention.

FIG. 9 illustrates a framing structure 900 according to one embodiment of the present invention. In this embodiment, a frame 966 is assembled into a gable end structure. In one illustrative example, frame 966 is assembled into a 16 foot× 16 foot gable end structure 968. This embodiment may include joists 970 on rafters 972. In this embodiment, posts 902 may receive floor loads via metal joists 970 (gauge to be determined) that are inserted into channels 958 at centers with metal spacers around the bay perimeter. Load bearing points may be distributed nine square. In a preferred embodiment, posts 902 may receive floor loads via 3-inch metal joists 970 (gauge to be determined) that are inserted into channels 958 at 16-inch centers with 3-inch metal spacers around the bay perimeter. Of course, larger or smaller sizes may be used in accordance with the present invention.

A deck 974 made, for example, of sine wave corrugated sheet metal may be spot-welded to aluminum sheet (gauges to be determined) and fastened to the joists 970. In one embodiment, the sine wave corrugated sheet metal is ½ inch sine wave corrugated sheet metal. The exterior cladding for the walls may be attached to studs arranged in a manner that is similar to the deck. In one illustrative embodiment, the exterior cladding for the walls may be attached to 3-inch studs arranged in a manner similar to the deck but with 2-foot spacing. The framing around the openings for windows and doors may be determined by that manufacturer's installation specifications. A roofing surface of sine wave corrugated aluminum may be fastened to this framing in a manner that is much like the deck. This prototype may have a pitched roof.

Figure 11:
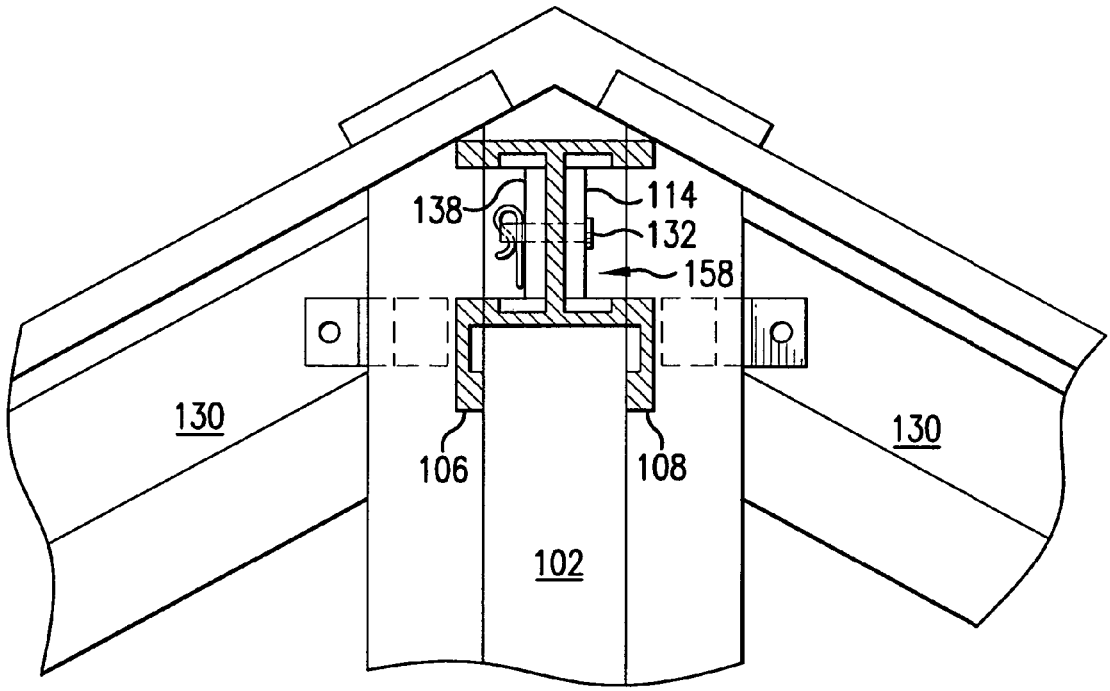
FIG. 11 is a roof peak connection joint using the embodiment shown in FIG. 1.

In one illustrative embodiment, the rafters are plumb cut to meet the post and may be secured with the fastener, as shown in FIG. 11. The post that supports the ridge beam may also be cut to match the pitch so that it may extend fully to the underside of the roofing.

Figure 10:
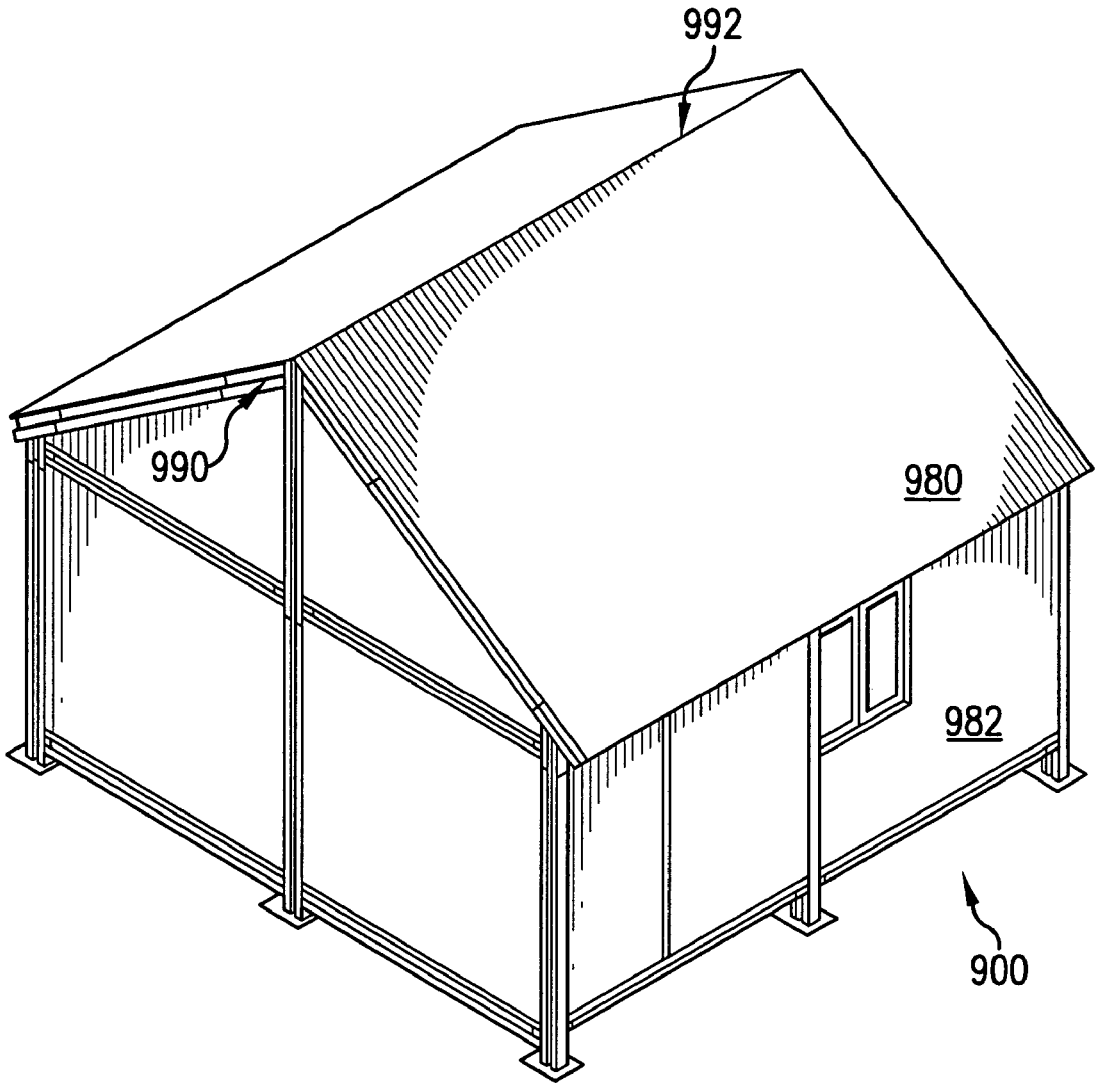
FIG. 10 is a framing structure for use with an embodiment of the present invention.

In FIG. 10 is shown the framing structure 900 of FIG. 9 with a roof 980 and walls 982. Framing structure 900 may continue indefinitely along the axis 990 of the ridge 992. This may be the case for schools or hospitals. In one embodiment, the other axis may extend from approximately 10 to 30 feet, preferably from approximately 13 to 25 feet, and more preferably from approximately 16 to 20 feet. Of course, larger or smaller sizes may be used in accordance with the present invention.

The foregoing has described the principles, embodiments, and modes of operation of the present invention. However, the invention should not be construed as being limited to the particular embodiments described above, as they should be regarded as being illustrative and not restrictive. It should be appreciated that variations may be made in those embodiments by those skilled in the art without departing from the scope of the present invention.

While the invention has been described in detail above, the invention is not intended to be limited to the specific embodiments as described. It is evident that those skilled in the art may now make numerous uses and modifications of and departures from the specific embodiments described herein without departing from the inventive concepts.

While various embodiments of the present invention have been described above, they should be understood to have been presented by way of examples only, and not limitation. Thus, the breadth and scope of the present invention should not be limited by the above described embodiments.

Obviously, numerous modifications and variations of the present invention are possible in light of the above teachings. It is therefore to be understood that the invention may be practiced otherwise than as specifically described herein.

What is claimed is:

1. A modular frame connector system comprising:

a post having a web and a front and rear flanges disposed fixedly on said web;

a front lip disposed fixedly on a lower surface of said front flange distal from said web;

a front fastening plate having a front camming end disposed insertably between said front and rear flanges and a front pierced end, said front camming end comprising further:

a front abutment surface substantially orthogonal to said front fastening plate and abutting said web;

a front finger surface disposed insertably between said front lip and said web and abutably to said front flange;

a front complementary surface disposed substantially parallel to said front fastening plate; and a planar front camming surface disposed at a first predetermined angle to said front abutment surface and said front complementary surface;

a rear lip disposed fixedly on an upper surface of said rear flange substantially opposite said front lip and distal from said web;

a rear fastening plate having a rear camming end disposed insertably between said front complementary surface and said rear flange and a rear pierced end, said rear camming end comprising further:

a rear abutment surface substantially orthogonal to said rear fastening plate and abutting said web;

a rear finger surface disposed insertably between said rear lip and said web and abutably to said rear flange;

a rear complementary surface disposed substantially parallel to said rear fastening plate and abutably to said front complementary surface; and a planar rear camming surface disposed at a second predetermined angle to said rear abutment surface and said rear complementary surface;

wherein said planar front camming surface is disposed abutably against said planar rear camming surface while said front and rear pierced ends are separated to insert said front and rear camming end between said front and rear flanges.

2. The modular frame connector system of claim 1, comprising further a structural member disposed insertably between said front and rear pierced ends.

3. The modular frame connector system of claim 2, wherein said structural member is selected from the group consisting of:

a second post, a beam, a joist, a stud, a panel, and a fastener.

4. The modular frame connector system of claim 2, comprising further a fastener disposed pierceably through said front and rear pierced ends and said structural member.

5. The modular frame connector system of claim 4, wherein said fastener is selected from the group consisting of:

a pin, a bolt, a rivet, and a spike.

6. The modular frame connector system of claim 1, wherein said post comprises a beam.

7. A modular frame connector system comprising:

a post having a web and a front and rear flanges disposed fixedly on said web;

a front lip disposed fixedly on a lower surface of said front flange distal from said web;

a front fastening plate having a front camming end disposed insertably between said front and rear flanges and a front pierced end, said front camming end comprising further:

a front abutment surface substantially orthogonal to said front fastening plate and abutting said web;

a front finger surface disposed insertably between said front lip and said web and abutably to said front flange;

a front complementary surface disposed substantially parallel to said front fastening plate; and a planar front camming surface disposed at a first predetermined angle to said front abutment surface and said front complementary surface;

wherein said planar front camming surface is disposed abutably against said rear flange while said front pierced end is raised to insert said front camming end between said front and rear flanges.

8. The modular frame connector system of claim 7, comprising further a structural member disposed proximate to said front pierced end.

9. The modular frame connector system of claim 8, wherein said structural member is selected from the group consisting of:

a second post, a beam, a joist, a stud, a panel, and a fastener.

10. The modular frame connector system of claim 8, comprising further a fastener disposed pierceably through said front pierced end and said structural member.

11. The modular frame connector system of claim 10, wherein said fastener is selected from the group consisting of:

a pin, a bolt, a rivet, and a spike.

12. The modular frame connector system of claim 7, wherein said post comprises a beam.

13. A method of modular frame connection comprising:

providing a modular frame connector system, said modular frame connector system comprising:

a post having a web and a front and rear flanges disposed fixedly on said web;

a front lip disposed fixedly on a lower surface of said front flange distal from said web;

a front fastening plate having a front camming end disposed insertably between said front and rear flanges and a front pierced end, said front camming end comprising further:

a front abutment surface substantially orthogonal to said front fastening plate;

a front finger surface disposed insertably between said front lip and said web and abutably to said front flange;

a front complementary surface disposed substantially parallel to said front fastening plate; and a planar front camming surface disposed at a first predetermined angle to said front abutment surface and said front complementary surface;

a rear lip disposed fixedly on an upper surface of said rear flange substantially opposite said front lip and distal from said web;

a rear fastening plate having a rear camming end disposed insertably between said front complementary surface and said rear flange and a rear pierced end, said rear camming end comprising further:

a rear abutment surface substantially orthogonal to said rear fastening plate;

a rear finger surface disposed insertably between said rear lip and said web and abutably to said rear flange;

a rear complementary surface disposed substantially parallel to said rear fastening plate and abutably to said front complementary surface; and a planar rear camming surface disposed at a second predetermined angle to said rear abutment surface and said rear complementary surface;

abutting said planar front camming surface of said front camming end of said front fastening plate against said planar rear camming surface of said rear camming end of said rear fastening plate while said front pierced end of said front fastening plate and said rear pierced end of said rear fastening plate are separated;

inserting said front and rear camming ends between said front and rear flanges of a post; and rotating said front pierced end toward said rear pierced end until said front finger surface of said front camming end is disposed insertably between said front lip of said front flange and said web of said post and abutably to said front flange and said front abutment surface substantially orthogonal to said front fastening plate is abutting said web;

rotating said rear pierced end toward said front pierced end until said rear finger surface of said rear camming end is disposed insertably between said rear lip of said rear flange and said web of said post and abutably to said rear flange and said rear abutment surface substantially orthogonal to said rear fastening plate abutting said web.

14. The method of modular frame connection of claim 13, comprising further inserting a structural member between said front and rear pierced ends.

15. The method of modular frame connection of claim 13, comprising further fastening said front and rear pierced ends and said structural member together.

16. The method of modular frame connection of claim 13, wherein said post comprises a beam.

* * * * *